US007004317B2

(12) United States Patent
Severa et al.

(10) Patent No.: US 7,004,317 B2
(45) Date of Patent: Feb. 28, 2006

(54) ENVIRONMENTALLY CONTROLLED SPORTS EQUIPMENT BAG

(75) Inventors: William D. Severa, West Chicago, IL (US); Ronald R. Rocchi, Naperville, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 524 days.

(21) Appl. No.: 10/121,070

(22) Filed: Apr. 12, 2002

(65) Prior Publication Data

US 2003/0192789 A1 Oct. 16, 2003

(51) Int. Cl.
*B65D 85/20* (2006.01)

(52) U.S. Cl. ..... 206/315.1; 206/204; 206/314; 206/524.1; 190/125

(58) Field of Classification Search ..... 206/204, 206/319.1, 14, 314, 524.1, 524.2, 524.3; 190/124, 125; 383/110
See application file for complete search history.

(56) References Cited

U.S. PATENT DOCUMENTS

| | | | | | |
|---|---|---|---|---|---|
| 3,707,279 | A | | 12/1972 | Kaiser | 263/2 |
| 3,800,863 | A | | 4/1974 | Bauman, Jr. | 165/47 |
| 4,177,845 | A | * | 12/1979 | Intengan | 206/315.1 |
| 4,262,798 | A | | 4/1981 | Raab | 206/315 |
| 4,378,866 | A | | 4/1983 | Pelavin | 190/52 |
| 4,506,759 | A | | 3/1985 | Franco et al. | 190/108 |
| 4,679,242 | A | * | 7/1987 | Brockhaus | 383/4 |
| 4,752,008 | A | | 6/1988 | Pratt | 206/579 |
| 4,805,748 | A | | 2/1989 | Gerch | 190/103 |
| 4,805,749 | A | * | 2/1989 | Gerch | 190/111 |
| 4,830,154 | A | * | 5/1989 | Gerch et al. | 190/103 |
| 4,925,711 | A | * | 5/1990 | Akao et al. | 428/35.2 |
| 4,927,015 | A | * | 5/1990 | Jones | 206/315.9 |
| 5,005,679 | A | * | 4/1991 | Hjelle | 190/110 |
| 5,062,528 | A | | 11/1991 | Whitaker, Jr. | 206/315 |
| 5,090,526 | A | | 2/1992 | Jacober | 190/107 |
| 5,114,003 | A | * | 5/1992 | Jackisch et al. | 206/204 |
| 5,191,721 | A | | 3/1993 | Incorvia et al. | 34/1 |
| 5,219,075 | A | * | 6/1993 | White | 206/314 |
| 5,341,927 | A | | 8/1994 | Coyner | 206/315.3 |
| 5,413,199 | A | * | 5/1995 | Clement | 190/108 |
| 5,547,075 | A | * | 8/1996 | Hoogerwoord | 206/204 |
| 5,567,040 | A | * | 10/1996 | Tabanera | 362/108 |
| 5,638,979 | A | * | 6/1997 | Shea | 220/1.6 |
| 5,676,451 | A | * | 10/1997 | Tabanera | 362/156 |
| 5,834,738 | A | | 11/1998 | Wilson | 219/400 |
| 5,860,415 | A | | 1/1999 | Waters | 126/680 |
| 5,881,875 | A | * | 3/1999 | Beurekjian | 206/315.9 |
| 5,884,762 | A | | 3/1999 | Roncato | 206/315.1 |
| 5,904,230 | A | * | 5/1999 | Peterson | 190/107 |
| 5,915,373 | A | | 6/1999 | Malover et al. | 126/263.02 |
| 5,921,388 | A | * | 7/1999 | Petrilli et al. | 206/321 |
| 5,975,293 | A | | 11/1999 | Fowler | 206/315.9 |
| 5,998,771 | A | | 12/1999 | Mariano et al. | 219/528 |
| 6,092,661 | A | * | 7/2000 | Mogil | 206/579 |
| 6,135,273 | A | * | 10/2000 | Cuen | 206/204 |
| 6,229,132 | B1 | | 5/2001 | Knetter | 219/759 |
| 6,283,287 | B1 | * | 9/2001 | Carl | 206/314 |
| 6,306,459 | B1 | | 10/2001 | Fleming | 427/163.4 |
| 2002/0070129 | A1 | * | 6/2002 | Tunstall-Behrens | 206/204 |
| 2004/0028296 | A1 | * | 2/2004 | Meli | 383/110 |

* cited by examiner

*Primary Examiner*—David T. Fidei
(74) *Attorney, Agent, or Firm*—Terence P. O'Brien

(57) ABSTRACT

A sports equipment bag includes a flexible elongated body defining an equipment storage region. The body includes at least one recloseable opening and an outwardly facing reflective barrier layer having a reflectivity of at least 80 percent. At least a portion of the barrier layer is viewable from outside of the bag.

13 Claims, 6 Drawing Sheets

ENVIRONMENTALLY CONTROLLED SPORTS EQUIPMENT BAG

FIELD OF THE INVENTION

The present invention relates generally to a sports equipment bag. In particular, the present invention relates to a sports equipment bag constructed to significantly reduce or eliminate the effect of sunlight, moisture and heat on the contents of the equipment bag.

BACKGROUND OF THE INVENTION

Sport equipment bags are well known. Sport equipment bags typically are soft-sided duffle-type bags and are made in a variety of different shapes and sizes. Many sports bags, such as tennis racquet bags, are specifically configured to store one or more tennis racquets and related equipment, such as balls, grips, etc. The equipment bags often include multiple compartments, as well as one or more openings, handles and straps. In competitive play, players, particularly tennis players, typically carry their sports equipment to the sporting venue using an equipment bag. These equipment bags are typically placed near the play area, and often are fully exposed to environmental conditions such as sunlight, moisture and heat.

Existing sport equipment bags have some drawbacks. Since most sporting events take place outdoors, the equipment bags are often subjected to the outdoor weather conditions, including sunlight, moisture and heat, over an extended period of time. Such exposure can damage or reduce the useful life of some sporting goods, especially sporting goods stored in equipment bags. For example, extended or severe exposure to ultraviolet radiation, heat or moisture can damage or reduce the life of the strings and the grip of a tennis racquet. In particular, the play characteristics of racquet strings can be negatively affected through exposure to extreme environmental conditions, even over the course of a single match. Existing sport equipment bags typically provide little or no protection for the sporting goods positioned within the bag against the damaging effects of ultraviolet radiation, heat, cold and moisture.

Thus, there is a continuing need for a sports equipment bag that inhibits the transmission of sunlight and ultraviolet radiation through the equipment bag. There is also a need for a lightweight equipment bag that absorbs or reduces the moisture content within the bag. What is also needed is a sports equipment bag that is configured to maintain the contents of the bag at a temperature below ambient temperature. Further, it would be advantageous to provide a moisture-absorbing, self-cooling and/or self-heating bag that can be easily re-charged or renewed.

SUMMARY OF THE INVENTION

The present invention provides a sports equipment bag including a flexible elongated body defining an equipment storage region. The body includes at least one recloseable opening and an outwardly facing reflective barrier layer having a reflectivity of at least 80 percent. At least a portion of the reflective barrier layer is viewable from outside of the bag.

According to a principal aspect of the invention, a sports equipment bag for carrying racquets, bats, other elongate sport implements and the like includes an elongated pliable body. The body has an exterior surface, an interior surface and at least one recloseable opening. The body defines an equipment storage region sufficiently sized to store at least two elongate sport implements. At least a portion of the interior surface includes a reflective barrier layer having a reflectivity of at least 80 percent.

According to another preferred aspect of the invention a tennis equipment bag for carrying racquets and related tennis equipment includes an elongated pliable body and one or more of a moisture-absorbing element, a cooling element and a heating element. The body has an exterior surface, an interior surface and at least one recloseable opening. The body defines an equipment storage region sufficiently sized to store at least one tennis racquet. The body includes a layer of thermal insulating material. Each of the moisture-absorbing, heating or cooling elements is removably retained within the equipment storage region of the bag.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
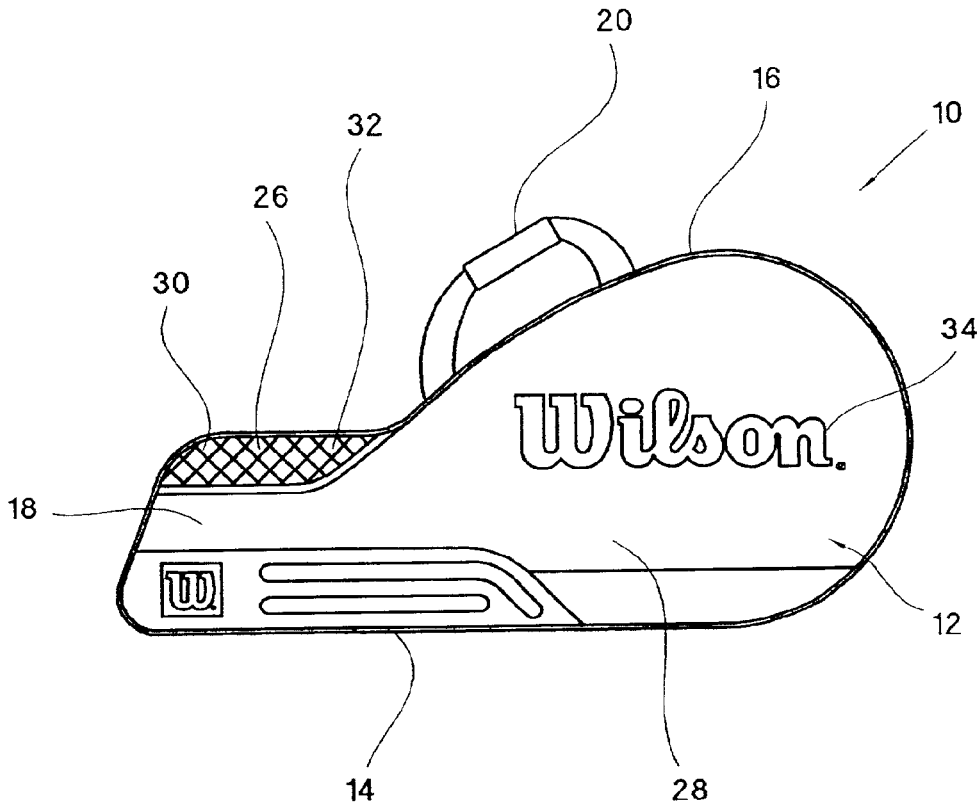
FIG. 1 is a side view of a sports equipment bag in accordance with a preferred embodiment of the present invention.
Figure 2:
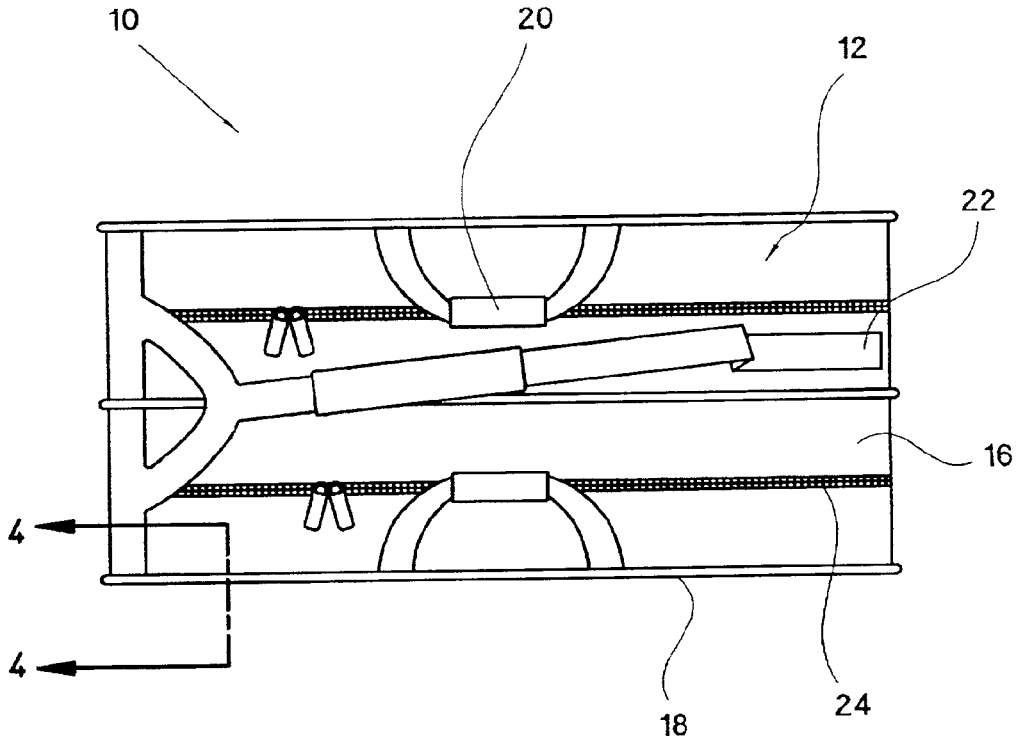
FIG. 2 is a top view of the sports equipment bag of FIG. 1.

Referring to FIGS. 1–2, a preferred embodiment of a sports equipment bag is indicated generally at 10. The bag 10 includes a lightweight, flexible body 12 having a bottom wall 14, a top wall 16 and at least one side wall 18 connecting the top and bottom walls 14 and 16. The bag 10 is configured to: retain a variety of sports equipment; to enable a user to readily store or transport the bag 10 and its contents; and to reduce the detrimental effect of the environment, including sunlight, moisture, and temperature variations, on the contents of the bag 10. The bag 10 farther includes at least one handle 20, at least one strap 22 and at least one reclosable opening 24. The handle 20 outwardly extends from the body 12 to enable the user to readily grasp the bag 10. The strap 22 is preferably a conventional adjustable shoulder strap. The reclosable opening 24 includes a releasable fastener, preferably a zipper. Alternative releaseable fasteners can also be used including, snaps, hook and loop fasteners, buttons, and other conventional fasteners.

Referring to FIG. 1, the side wall 18 includes an exposed reflective side portion 26 extending over at least a portion of the side wall 18 and connected to a covered side portion 28 extending over the remainder of the side wall 18. The exposed reflective side portion 26 preferably extends over at least 5% of the outer surface area of the side wall 18. The exposed reflective side portion 26 includes an outer open mesh layer 30 extending over an outer reflective barrier layer 32. The open mesh layer 30 includes a plurality of openings making the outer reflective layer 32 visible from outside of the bag 10. The body 12 can also include alphanumeric and/or graphical indicia 34. In an alternative preferred embodiment, the side wall 18 includes a reflective side portion which is substantially covered with a layer of material.

Figure 3:
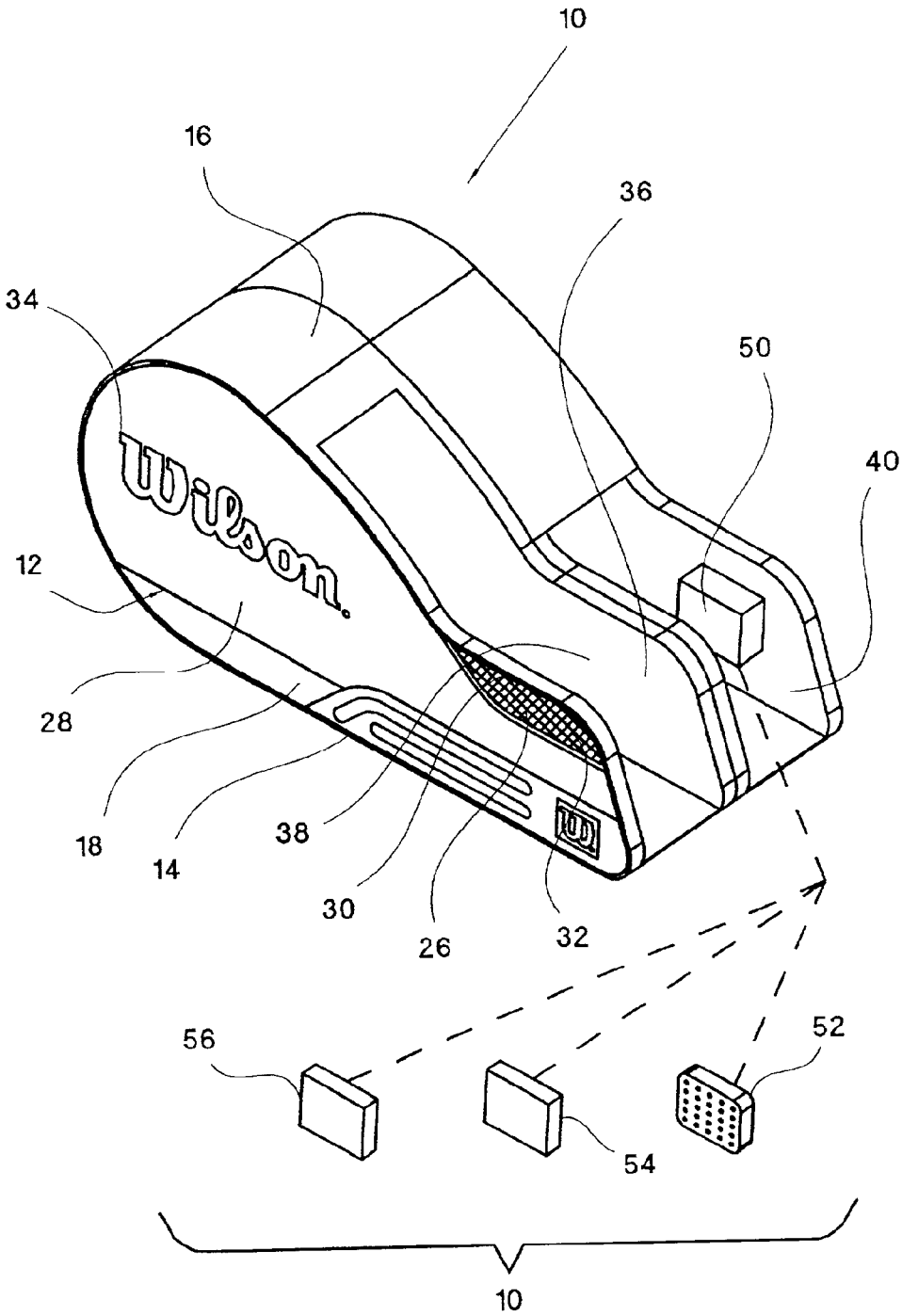
FIG. 3 is front perspective, partial sectional view of the sports equipment bag of FIG. 1 with a moisture-absorbing element, a cooling element and a heating element shown in an exploded view position.

Referring to FIG. 3, the bottom, top and side walls 14, 16 and 18 of the body 12 define at least one equipment storage compartment. In one preferred embodiment, the bag 10 further includes a longitudinally extending dividing wall 36 connected at first and second edges to the bottom and top walls 14 and 16, respectively, to define opposing first and second equipment storage compartments 38 and 40. The dividing wall 36 provides additional support to the body 12 and protects the contents of the first storage compartment 38 from impacting the contents of the second storage compartment 40. In one particularly preferred embodiment, the first and second storage compartments 38 and 40 are contoured to generally conform to the shape of one or more tennis racquets. In alternative preferred embodiments, the body and the storage compartments can be sized to entirely receive at least one racquet. In particularly preferred embodiments, the body 12 is contoured to receive two, three, four or six racquets and other related tennis equipment. In alternative embodiments, other body shapes and sizes can be used. In a particularly preferred embodiment, at least one of the compartments 38 and 40 is moisture-proof. In another alternative embodiment, the bag 10 can include one or more subdividers (not shown) for storing multiple sport implements side by side, such as, for example, tennis racquets.

Figure 4:
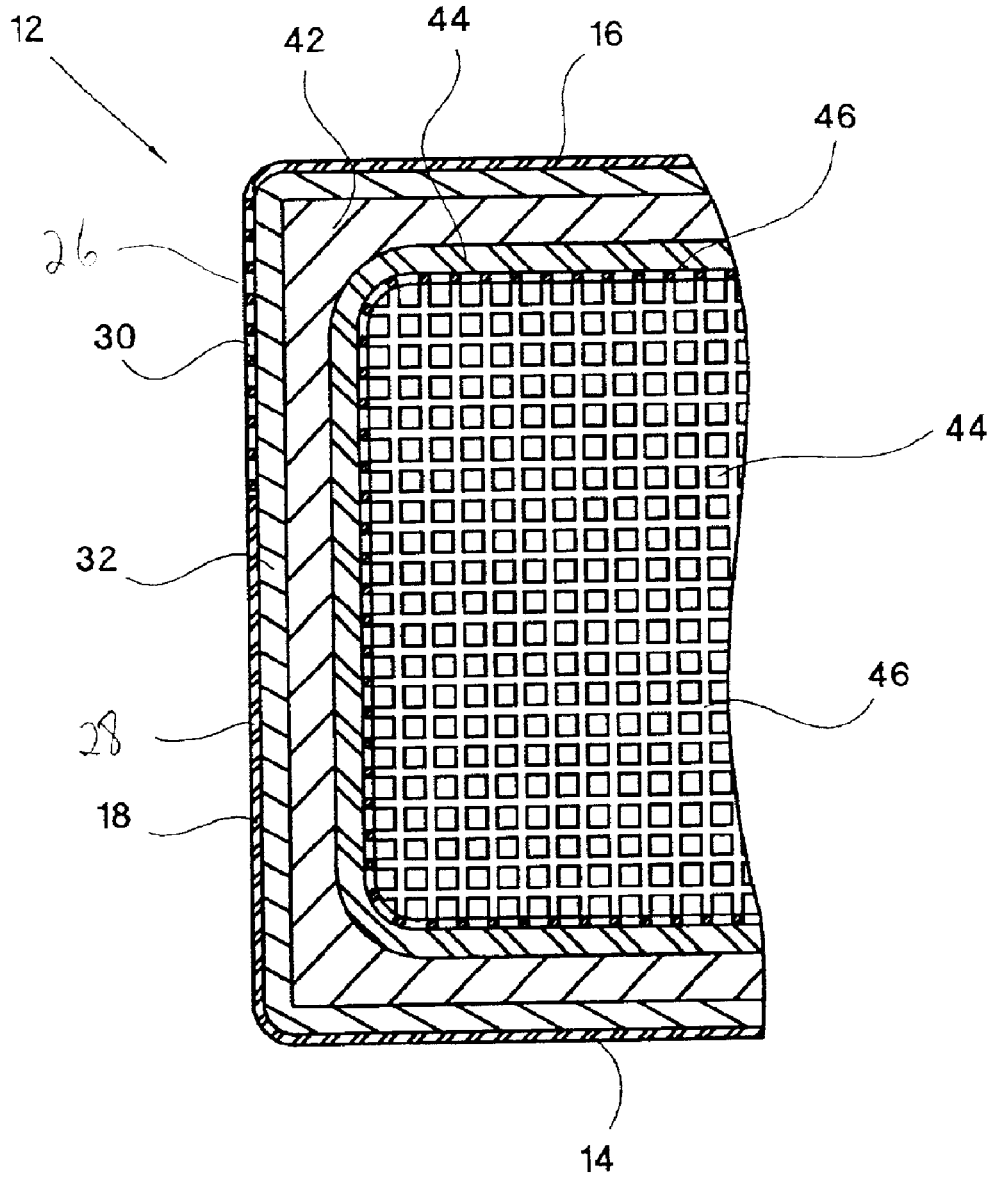
FIG. 4 is a sectional view of the sports equipment bag taken along line 4—4 of FIG. 2.
Figure 6:
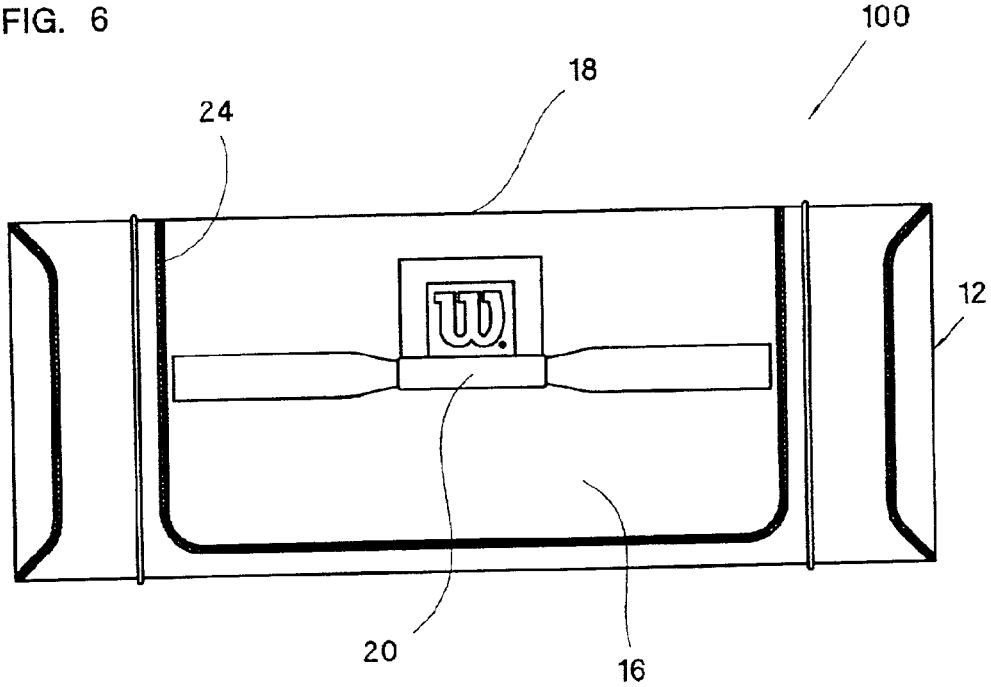
FIG. 6 is a top view of the sports equipment bag of FIG. 5.
Figure 5:
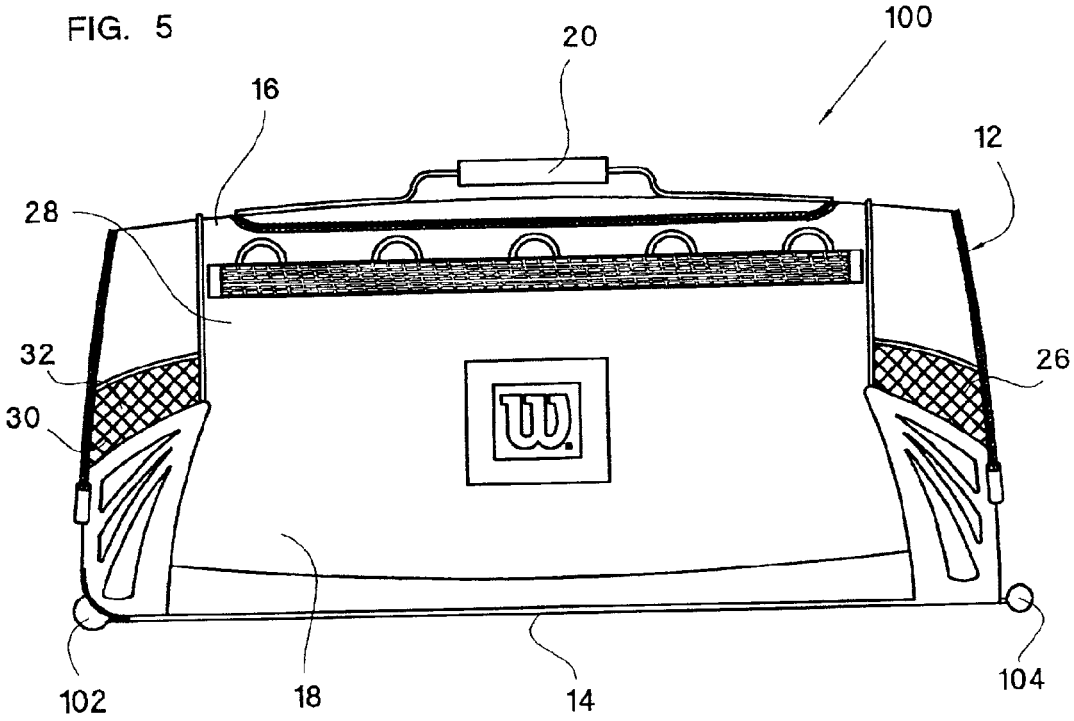
FIG. 5 is a side view of a sports equipment bag in accordance with an alternative preferred embodiment of the present invention
Figure 7:
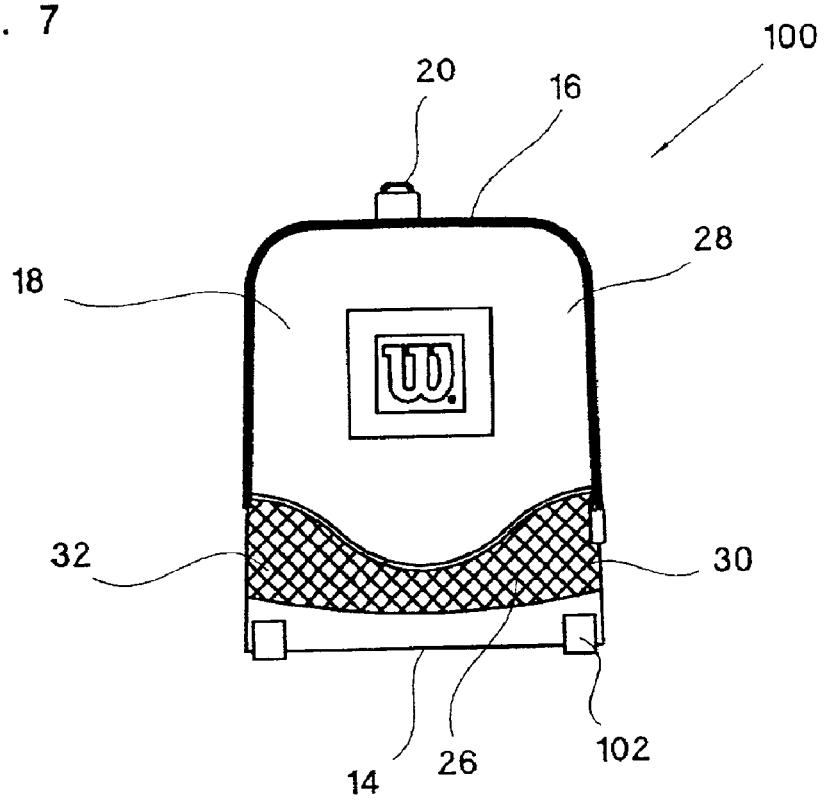
FIG. 7 is a first end view of the sports equipment bag of FIG. 5.
Figure 8:
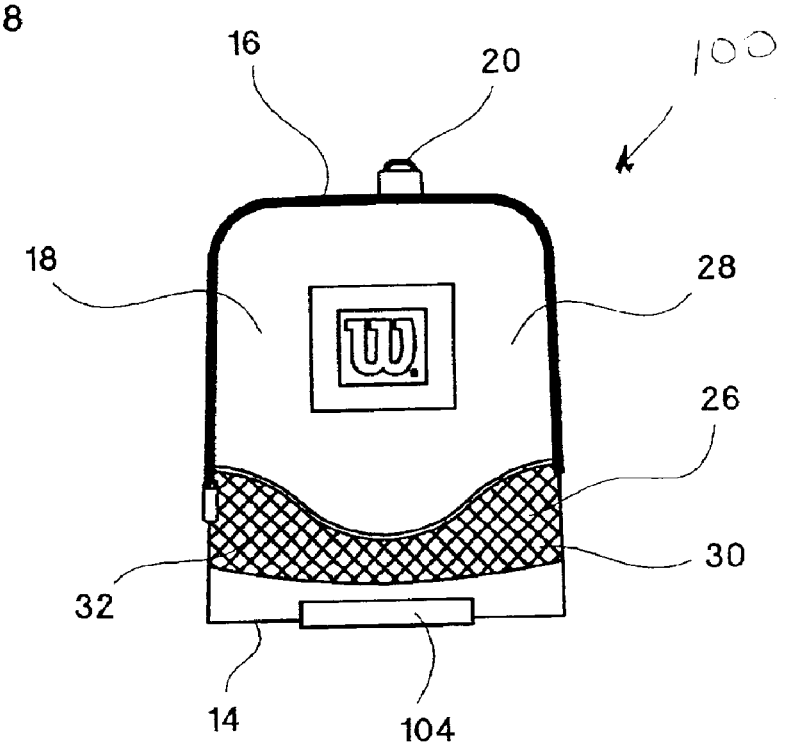
FIG. 8 is a second end view of the sports equipment bag of FIG. 5

Referring to FIGS. 3 and 4, the walls of the body 12 include at least one layer of reflective material and at least one layer of insulating material. In a preferred embodiment, at least one of the walls of the bag 10, such as the side wall 18, includes an outermost layer formed by the outer open mesh layer 30 and the covered side portion 28, the outer reflective layer 32, at least one insulated layer 42, an inner reflective barrier layer 44, and a inner open mesh layer 46. The outer reflective layer 32 is includes an outwardly facing reflective surface and is positioned at least on the inner side of the mesh layer 30 and, preferably, also on the inner side of the covered side portion 28. The insulated layer 42 is positioned on the inner side of the outer reflective layer 32. The inner reflective layer 44 is positioned adjacent to the inner surface of the insulated layer 42 and includes an inwardly facing reflective surface. The inner open mesh layer 46 extends over the inner surface of the inner reflective material 44.

The inner and outer open mesh layers 30 and 46 are flexible lattice structures that enable the underlying reflective material to be viewable through the openings of the inner and outer mesh layer 30 and 46. The inner and outer mesh layers 30 and 46 each have a periphery that connected, and preferably stitched, to the underlying inner and outer reflective layers 32 and 44, respectively, such that the central portion of the inner and outer mesh layers 30 and 46 is not firmly secured to the inner and outer reflective layers 32 and 44. In an alternative embodiment, the inner and outer mesh layers are secured to the inner and outer reflective layers at their peripheries and their central portions. The inner and outer mesh layers 28 and 46 are formed of a pliable material, preferably a nylon. In alternative preferred embodiments, the mesh layer 30 can be formed of an elastomeric material, a plastic, or a textile. The mesh layers 30 and 46 are preferably formed in a darker color that contrasts with the reflective layers 32 and 44 thereby providing the bag 10 with a unique aesthetically appealing appearance. Alternatively, the inner and outer mesh layers 30 and 46 can be formed in any combination of one or more colors. In alternative preferred embodiments, the bag 10 can be formed without one or both of the inner and outer mesh layers 30 and 46.

The inner and outer reflective layers 32 and 44 are flexible sheets of reflective material. The inner and outer reflective layers 32 and 44 are connected at least at their peripheries to the insulating layer 40 and the inner and outer mesh layers 30 and 46. The reflective layers 32 and 44 inhibit sunlight and ultraviolet ("UV") radiation from passing through the body 12. The reflective layers 32 and 44 have a reflectivity of at least 80 percent, and preferably, at least 100 percent. In alternative preferred embodiments, the body 12 can be formed with only an inner reflective layer or with only an outer reflective layer.

The reflective layers 32 and 44 can comprise a diffuse reflective material wherein the reflected light diffusely reflects from the direction of the incident beam. Diffuse reflection occurs when light strikes a rough surface, which causes the light beams to scatter in all directions.

In an alternative preferred embodiment, the reflective layers 32 and 44 comprise a mirror-like (specular) material having a microscopically smooth outer surface wherein the angle of the reflected beam is equal to the angle of the incident beam and both beams lie in a single plane. Mirror-like reflection occurs when light strikes a smooth or glossy surface. When a mirror-like reflective material is used, the reflectivity can exceed 100 percent. In one particularly preferred embodiment, the reflective material is an aluminum foil type reflective material.

In another alternative preferred embodiment, the reflective layers 32 and 44 can be a retroreflective material wherein the retroreflected beam is returned in the same direction from which the incident beam came. The retroreflective material includes a plurality of small glass beads, prisms or cube corner elements to reflect light. When a retroreflective material is used, the reflectivity can exceed 100 percent. In particular, when the reflective layers 32 and 44 are formed of a retroreflective material, such as 3M™ Scotchlite™ reflective material, produced by 3M Corporation of St. Paul, Minn., the brightness or coeffficient of retroreflection can range between 100 to 700 in cd/lux/$m^2$. The coefficient of retroreflection is measured at an entrance angle of −4 degrees and at an observation angle of 0.2 degrees. In one particularly preferred embodiment, a 3M™ Scotchlite™ high gloss reflective material, product number 6160 can be used having a coefficient of retroreflection of 700 in cd/lux/$m^2$.

The outer reflective layer 32 reflects sunlight and UV energy, thereby preventing, or significantly reducing the amount of, UV energy entering the bag 10. By reducing or eliminating the admission of UV energy into the compartments 38 and 40 of the bag 10, the contents of the bag 10 are protected from potentially damaging exposure to UV radiation. The outer reflective layer 32 also helps to limit the transfer of radiation heat through the bag 10 and, therefore, also assists in limiting the temperature increase within the bag 10. The inner reflective layer 32 brightens the compartments 38 and 40 when the bag 10 is opened thereby facilitating the insertion, or removal of, equipment into, or from, the bag 10. The inner reflective material 32 also provides the bag 10 with a unique pleasing appearance. Additionally, the inner reflective material 32 can serve as an additional thermal insulating layer that resists temperature changes within the bag 10.

The insulated layer 42 is a flexible sheet of lightweight thermal insulating material having a low thermal conductivity. In a particularly preferred embodiment, the insulated layer 42 a "bubble-wrap" type material. The bubble-wrap material includes two sheets of material heat sealed together to form a plurality of air bubbles. The insulated layer 42 can include single sided or double sided bubble-wrap. In alternative preferred embodiments, the insulated layer 42 can include an insulating foam, such as a cellular compressible polyethylene foam, a cellulose insulation, or other lightweight insulating material. The insulated layer 42 reduces heat transfer through the body 12 thereby inhibiting or reducing thermal energy loss through the bag 10. The insulating layer 42 helps to limit temperature fluctuations within the bag 10 by resisting the passage of thermal energy from the outside environment into the bag 10, and vice versa.

The dividing wall 32 can include a similar structure to the side wall structure described above. In alternative preferred embodiments, the side wall structure described above can be positioned in one or more of the side, top and bottom walls 18, 16 and 14 of the body 12, or in any portion of the body 12.

Referring to FIG. 3, the bag 10 also includes at least one internal pocket 50 secured to an inner surface of the body 12 for removably receiving and retaining a moisture-absorbing element 52, a cooling element 54 or a heating element 56. The bag 10 can include multiple pockets and one or more of the elements 52, 54 and 56. In an alternative preferred embodiment, the moisture-absorbing, heating or cooling elements 52, 54, 56 are retained within the bag 10 by other means, such as, for example, hook and loop connectors, or straps with quick release connectors.

The moisture absorbing element 52 is a lightweight, compact, portable unit configured to absorb moisture and to reduce humidity within the compartments 38 and 40 of the body 12. The moisture-absorbing element 52 is preferably a desiccant container. In a particularly preferred embodiment, the moisture-absorbing element 52 is a rechargeable desiccant canister, such as the microwave regenerable desiccant cartridge commercially available under the mark DRICAN® and manufactured by Multisorb Technologies, Inc. of Buffalo, N.Y. In alternative preferred embodiments, the desicant can be disposable, rechargeable or non-rechargeable and it can be packaged in tear-resistant bag, a cylinder, or other conventional packaging. In alternative preferred embodiments, other portable conventional moisture absorbing elements can be used, such as, for example, a compact manually activated cooling pack.

The cooling element 54 is a compact portable unit configured to reduce or maintain the temperature within the first and second compartments 38 and 40 of the bag. The cooling element 54 is preferably a freezer pack. In a particularly preferred embodiment, the cooling element is a ice substitute bag marketed under the BLUE ICE® trademark and manufactured by Rubbermaid of Wooster, Ohio. By maintaining or reducing the temperature of the compartments 38 and 40 of the bag 10, the contents of the bag 10 can be maintained at a cooler temperature than the outside ambient temperature and can be protected from the potentially damaging effects of acute or prolonged heat.

The heating element 56 is a compact portable unit configured to increase or maintain the temperature within the first and second compartments 38 and 40 of the bag. The heating element 56 is preferably a flexible, rechargeable heat pack comprised of a substance that accepts and retains energy a heat source, such as a microwave oven, and dissipates this heat energy over time through conentional heat tranafer mechanismes into the compartments 38 and 40 of the bag 10. In a particularly preferred embodiment, the heating element is a marketed under the MICROCORE® trademark and commercially available from Vesture Corporation of Asheboro, N.C. By maintaining or increasing the temperature of the compartments 38 and 40 of the bag 10, the contents of the bag 10 can be maintained at a warmer temperature than the outside ambient temperature and can be protected from the potentially damaging effects of acute or prolonged cold. In alternative preferred embodiments, the heating element can be a portable battery operated heater, a chemical heat pack, or other conventional portable heating element.

Referring to FIGS. 5–8, an alternative preferred embodiment of a sports equipment bag indicated generally at 100 is illustrated. The sports equipment bag 100 is substantially equivalent to, and includes all the features of, the bag 10. The bag 100 is configured differently than bag 10 for storing a larger quantity of sports equipment, including, but not limited to, sports clothing, balls, protective equipment, and elongate sport implements, such as, for example, tennis racquets and ball bats. The bag 100 further includes a set of wheel 102 and a second handle 104 for easily transporting the bag 100. The outer reflective layer 32 of the bag 100 is visible to the outside from each side and each end of the bag 100.

While the preferred embodiments of the present invention have been described and illustrated, numerous departures therefrom can be contemplated by persons skilled in the art. For example, the present invention can be applied to a back pack or other equipment bag configuration. Therefore, the present invention is not limited to the foregoing description but only by the scope and spirit of the appended claims.

What is claimed is:

1. A sports equipment bag comprising:

a flexible elongated body defining an equipment storage region, the body including at least one recloseable opening and an outwardly facing reflective barrier layer having a reflectivity of UV radiation or sunlight of at least 80 percent, at least a portion of the barrier layer being viewable from outside of the bag, and a cooling element removably secured to the body.

2. The equipment bag of claim 1 wherein the cooling element is selected from the group consisting of an ice pack, an ice-substitute pack, a compact manually activated cooling pack, and a combination thereof.

3. A sports equipment bag comprising:

a flexible elongated body defining an equipment storage region, the body including at least one recloseable opening and an outwardly facing reflective barrier layer having a reflectivity of UV radiation or sunlight of at least 80 percent, at least a portion of the barrier layer being viewable from outside of the bag, wherein the reflective barrier layer comprises a retroreflective material.

4. The equipment bag of claim 3, wherein the retroreflective material has a coefficient of retroreflection of at least 100 cd/lux/$m^2$.

5. A sport equipment bag for carrying racquets, bats, other elongate sport implements and the like, the equipment bag comprising:

an elongated pliable body having an exterior surface, an interior surface and at least one recloseable opening, the body defining an equipment storage region sufficiently sized to store at least two elongate sport implements, at least a portion of the interior surface includes a reflective barrier having a reflectivity of UV radiation or sunlight of at least 80 percent, and a cooling element removably secured to the body.

6. The equipment bag of claim 5 wherein the cooling element is selected from the group consisting of an ice pack, an ice-substitute pack, a compact manually activated cooling pack, and a combination thereof.

7. The equipment bag of claim 1, wherein the barrier layer is constructed to inhibit the transmission of ultraviolet radiation through the body.

8. The equipment bag of claim 1, wherein the reflective barrier layer comprises one of a diffuse reflective material, a specular reflective material and a retroreflective material.

9. The equipment bag of claim 1 wherein the body further includes a layer of thermal insulating material.

10. The equipment bag of claim 9 wherein the layer of thermal insulating material is selected from the group consisting of a single-sided bubble wrap, a double-sided bubble wrap, a compressible foam, and combinations thereof.

11. The equipment bag of claim 3, wherein the barrier layer is constructed to inhibit the transmission of ultraviolet radiation through the body.

12. The equipment bag of claim 3 wherein the body further includes a layer of thermal insulating material.

13. The equipment bag of claim 12 wherein the layer of thermal insulating material is selected from the group consisting of a single-sided bubble wrap, a double-sided bubble wrap, a compressible foam, and combinations thereof.

* * * * *